US010228118B2

(12) United States Patent
Yagi et al.

(10) Patent No.: US 10,228,118 B2
(45) Date of Patent: Mar. 12, 2019

(54) VEHICULAR LAMP

(71) Applicant: KOITO MANUFACTURING CO., LTD., Tokyo (JP)

(72) Inventors: Takayuki Yagi, Shizuoka (JP); Ryuho Sato, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/587,512

(22) Filed: May 5, 2017

(65) Prior Publication Data

US 2017/0328535 A1 Nov. 16, 2017

(30) Foreign Application Priority Data

May 12, 2016 (JP) ..... 2016-096024

(51) Int. Cl.

| | |
|---|---|
| ***F21S 41/143*** | (2018.01) |
| ***F21V 29/67*** | (2015.01) |
| ***F21V 29/504*** | (2015.01) |
| ***F21S 41/255*** | (2018.01) |
| ***F21S 41/265*** | (2018.01) |
| ***F21S 41/663*** | (2018.01) |
| ***F21S 45/43*** | (2018.01) |

(52) U.S. Cl.

CPC ..... *F21V 29/677* (2015.01); *F21S 41/143* (2018.01); *F21S 41/255* (2018.01); *F21S 41/265* (2018.01); *F21S 41/663* (2018.01); *F21S 45/43* (2018.01); *F21V 29/504* (2015.01)

(58) Field of Classification Search

CPC ..... F21S 48/10; F21S 48/01; F21S 48/1208; F21S 48/1216; F21S 48/125; F21S 48/1275; F21S 48/325; F21S 48/335; F21V 5/008; F21V 29/673; F21V 29/02; F21Y 2115/10; B60Q 1/04; B60Q 1/16

See application file for complete search history.

(56) References Cited

U.S. PATENT DOCUMENTS

| | | | | | |
|---|---|---|---|---|---|
| 4,577,260 | A * | 3/1986 | Tysoe | F21V 5/008 | 362/521 |
| 4,670,823 | A * | 6/1987 | Kochi | F21S 43/26 | 362/268 |
| 4,727,458 | A * | 2/1988 | Droste | F21S 41/19 | 362/539 |
| 5,014,166 | A * | 5/1991 | Draper | F21S 41/28 | 362/520 |
| 5,562,338 | A * | 10/1996 | Yamamoto | F21V 17/101 | 362/521 |

(Continued)

FOREIGN PATENT DOCUMENTS

| | | | | |
|---|---|---|---|---|
| DE | 102011004086 C5 * | 7/2016 | | |
| EP | 2431658 A2 * | 3/2012 | | F21S 48/1216 |

(Continued)

*Primary Examiner* — Hargobind S Sawhney
(74) *Attorney, Agent, or Firm* — Sughrue Mion, PLLC

(57) ABSTRACT

A vehicular lamp includes a projection lens made of resin; a light source that is disposed behind the projection lens, the vehicular lamp being configured such that light from the light source is emitted forward through the projection lens; a wind generator configured to generate wind; and a wind guide path configured to guide wind generated by the wind generator to a position where the wind hits a surface of the projection lens.

12 Claims, 5 Drawing Sheets

(56) References Cited

U.S. PATENT DOCUMENTS

| | | | | | |
|---|---|---|---|---|---|
| 5,658,072 | A * | 8/1997 | Natsume | F21S 43/26 | 362/521 |
| 6,045,246 | A * | 4/2000 | Goto | F21S 43/51 | 362/521 |
| 6,767,121 | B2 * | 7/2004 | Bost | F21S 43/50 | 362/521 |
| 6,966,654 | B2 * | 11/2005 | Ozawa | G03B 21/16 | 348/E5.143 |
| 7,278,768 | B2 * | 10/2007 | Gasquet | B60Q 1/2607 | 362/539 |
| 8,678,631 | B2 * | 3/2014 | Tominaga | F21S 48/1159 | 362/294 |
| 9,285,092 | B2 * | 3/2016 | Anzai | F21S 48/1283 | |
| 2008/0285297 | A1 * | 11/2008 | Ishida | F21S 41/143 | 362/539 |
| 2009/0303742 | A1 * | 12/2009 | Yasuda | F21S 48/1159 | 362/547 |
| 2010/0149494 | A1 * | 6/2010 | Kawachi | H05B 33/0803 | 353/57 |
| 2010/0253223 | A1 * | 10/2010 | Inoue | F21S 48/1159 | 315/82 |
| 2011/0051453 | A1 * | 3/2011 | Nagasawa | B60Q 1/007 | 362/547 |
| 2014/0340922 | A1 * | 11/2014 | Matsumoto | F21S 48/1109 | 362/516 |

FOREIGN PATENT DOCUMENTS

| | | | | |
|---|---|---|---|---|
| JP | 2007-227085 | A | | 9/2007 |
| KR | 2010048617 | A | * | 10/2010 |

* cited by examiner

VEHICULAR LAMP

INCORPORATION BY REFERENCE

The disclosure of Japanese Patent Application No. 2016-096024 filed on May 12, 2016 including the specification, drawings and abstract is incorporated herein by reference in its entirety.

BACKGROUND

1. Technical Field

The disclosure relates to a projector-type vehicular lamp.

2. Description of Related Art

A projector-type vehicular lamp has been known, which is configured such that light from a light source disposed behind a projection lens is emitted forward through the projection lens.

As an example of such a vehicular lamp, Japanese Patent Application Publication No. 2007-227085 (JP 2007-227085 A) describes a vehicular lamp including a resin projection lens.

The vehicular lamp described in JP 2007-227085 A has a structure in which a heat ray cutting filter is disposed between the projection lens and a light source.

SUMMARY

By using a resin projection lens, it is possible to reduce weight of a vehicular lamp as compared to a case where a glass projection lens is used. However, the refractive index and the focal distance of the resin projection lens change greatly due to an increase in the temperature of the projection lens. Therefore, a light distribution pattern formed by irradiation light from the vehicular lamp is likely to be degraded (in other words, visibility is reduced as compared to an expected light distribution pattern).

In this regard, when a heat ray cutting filter is disposed between the projection lens and the light source as described in JP 2007-227085 A, it becomes possible to suppress an increase in the temperature of the projection lens, but cost of the vehicular lamp is increased because the heat ray cutting filter is expensive.

The disclosure provides a projector-type vehicular lamp that makes it possible to suppress degradation of a light distribution pattern with an inexpensive structure even when a projection lens made of resin is used.

In the disclosure, degradation of a light distribution pattern is suppressed by employing a structure in which a projection lens is cooled with blowing wind.

An aspect of the disclosure relates to a vehicular lamp including a projection lens made of resin; a light source that is disposed behind the projection lens, the vehicular lamp being configured such that light from the light source is emitted forward through the projection lens; a wind generator configured to generate wind; and a wind guide path configured to guide wind generated by the wind generator to a position where the wind hits a surface of the projection lens.

A specific structure of the vehicular lamp according to the above-described aspect of the disclosure is not particularly limited. For example, it is possible to employ a structure in which the light from the light source enters the projection lens directly, or a structure in which the light from the light source enters the projection lens after being reflected by a reflector.

A kind of the above-described "light source" is not particularly limited. For example, a light emitting element such as a light emitting diode or a laser diode, or a light source bulb or the like may be employed.

A specific structure of the above-described "projection lens", such as its material and shape, is not particularly limited, as long as the projection lens is a projection lens made of resin. Also, the "projection lens" may be a single lens or may include a plurality of lenses.

A specific structure and a disposition of the above-described "wind generator" are not particularly limited, as long as the wind generator is configured to generate wind. For example, a motor fan, a piezoelectric fan, or the like may be used.

A specific structure and a wind guide route of the above-described "wind guide path" are not particularly limited, as long as the wind guide path is able to guide the wind generated by the wind generator to a position where the wind hits a surface of the projection lens.

The "surface of the projection lens" hit by wind guided by the wind guide path may be one surface or each of both surfaces of the projection lens.

The vehicular lamp according to the above-described aspect of the disclosure is configured as the projector-type vehicular lamp including the projection lens made of resin. Since the vehicular lamp includes the wind generator configured to generate wind, and the wind guide path configured to guide the wind generated by the wind generator to the position where the wind hits the surface of the projection lens, it is possible to cool the projection lens efficiently.

Thus, it is possible to suppress an increase in the temperature of the projection lens. Thus, large changes in the refractive index and the focal distance of the projection lens are prevented in advance. Therefore, it is possible to efficiently suppress degradation of a light distribution pattern formed by the light emitted from the vehicular lamp.

Moreover, it is possible to achieve the above-described effects with the less expensive structure as compared to a conventional case where a heat ray cutting filter is provided.

As described so far, according to the above-described aspect of the disclosure, in the projector-type vehicular lamp, it is possible to suppress degradation of the light distribution pattern with the inexpensive structure, even when the projection lens made of resin is used.

Moreover, by employing the structure according to the above-described aspect of the disclosure, it is possible to suppress an increase in the temperature of the projection lens, and to suppress an increase in the temperature of members located around the wind guide path.

In the above-described aspect, the projection lens may include a first lens and a second lens disposed at a given interval in a front-rear direction; and the wind guide path may be configured to guide the wind into a space between the first lens and the second lens. With this structure, it is possible to cool the projection lens extremely efficiently.

In the above-described aspect, the light source may include a light emitting diode supported by a heat sink, and the wind generator may be a cooling fan configured to dissipate heat of the heat sink. With this structure, since it is not necessary to provide an additional wind generator in order to cool the projection lens, it is possible to suppress degradation of a light distribution pattern with an even more inexpensive structure.

In the above-described aspect, the light source may include a plurality of light emitting diodes arranged in a grid pattern. With this structure, it becomes possible to form light distribution patterns in various shapes by selectively lighting some of the plurality of light emitting diodes. In this case, since the temperature of the projection lens tends to increase, use of the structure according to the above-described aspect of the disclosure is especially effective.

In the above-described aspect, the surface of the projection lens may be subjected to antireflection treatment. With this structure, it is possible to suppress degradation of a light distribution pattern, and to improve lamp efficiency.

In this case, the above-described "antireflection treatment" may be, for example, treatment of forming an antireflection film on the surface of the projection lens, or treatment of forming a moth-eye structure on the surface of the projection lens.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Herein below, an embodiment of the disclosure is explained with reference to the drawings.

Figure 1:
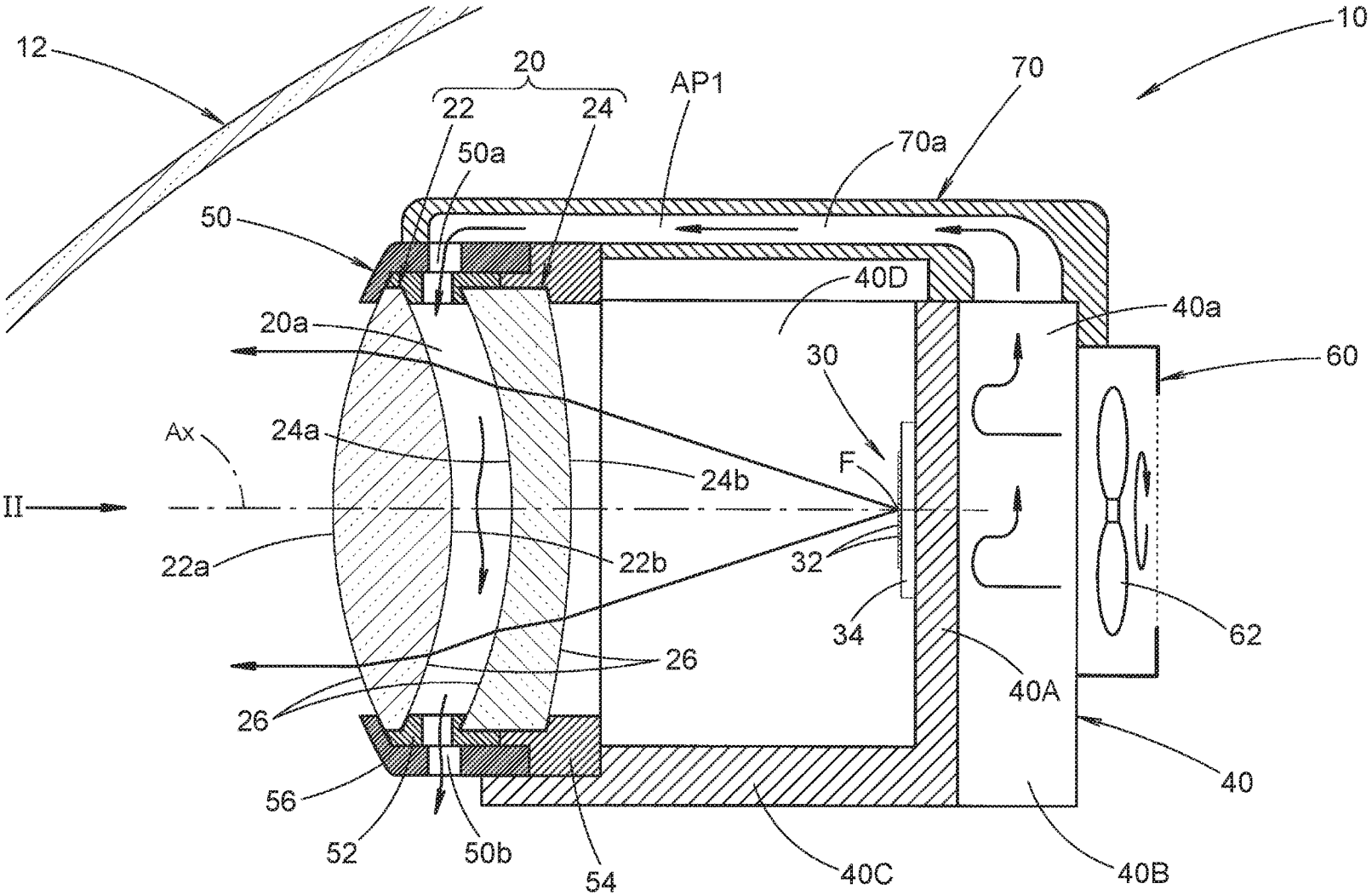
FIG. 1 is a side sectional view of a vehicular lamp according to an embodiment of the disclosure.
Figure 2:
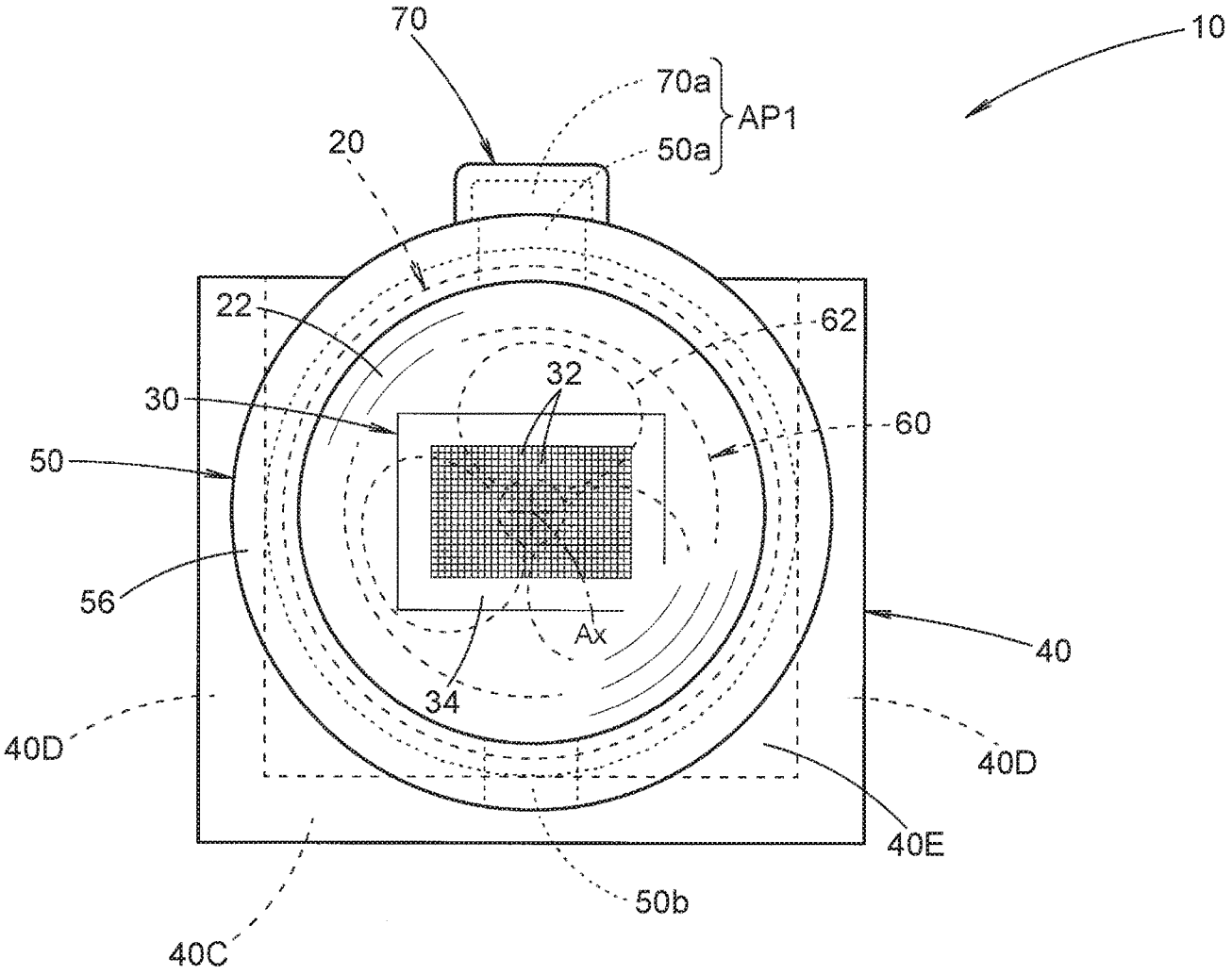
FIG. 2 is a view seen in a direction indicated by an arrow II in FIG. 1.

FIG. 1 is a side sectional view of a vehicular lamp according to an embodiment of the disclosure. FIG. 2 is a view seen in a direction indicated by an arrow II in FIG. 1.

As shown in these drawings, a vehicular lamp 10 according to the embodiment is a headlamp provided in a front end part of a vehicle. The vehicular lamp 10 is configured as a projector-type lamp unit provided in a lamp chamber that is formed by a lamp body (not shown) and a plain translucent cover 12 attached to cover a front end opening portion of the lamp body.

The vehicular lamp 10 includes a projection lens 20 having an optical axis Ax extending in a vehicle front-rear direction, a light source unit 30 disposed behind the projection lens 20, and a heat sink 40 that supports the light source unit 30.

The projection lens 20 includes first and second lenses 22, 24 disposed on the optical axis Ax at a given interval in the front-rear direction. Outer peripheral edge parts of the first and second lenses 22, 24 are supported by a common tubular holder 50, and the tubular holder 50 is supported by the heat sink 40. Specific structures of the projection lens 20 and the tubular holder 50 are described later.

The light source unit 30 has a structure in which a plurality of (for example, approximately 200 to 600) light emitting diodes 32, which are arranged in a vertical and horizontal direction in a grid pattern, are supported by a common base plate 34. The light emitting diodes 32 are white light emitting diodes, and are disposed on a rear-side focal plane of the projection lens 20 (that is, a focal plane including a rear-side focal point F of the projection lens 20) such that light emitting surfaces of the light emitting diodes 32 are directed toward the front of the lamp.

The heat sink 40 is a member made of metal, and includes a body 40A extending along a vertical plane orthogonal to the optical axis Ax, a plurality of heat dissipation fins 40B extending rearward from the body 40A, a bottom wall part 40C and side wall parts 40D extending forward from a lower end part and both right and left end parts of the body 40A, and a front wall part 40E disposed at front end parts of the bottom wall part 40C and the pair of right and left side wall parts 40D so as to extend along a vertical plane orthogonal to the optical axis Ax. The heat dissipation fins 40B are formed so as to extend in an upper-lower direction, and are disposed at given intervals in a right-left direction.

In the heat sink 40, the body 40A supports the light source unit 30, and the front wall part 40E supports the tubular holder 50.

A cooling fan 60 is attached to the heat sink 40 in order to dissipate heat of the heat sink 40. The cooling fan 60 is disposed so as to be in contact with rear end surfaces of the plurality of heat dissipation fins 40B. The cooling fan 60 may be a motor fan (or a piezoelectric fan). Wind generated by a fan body 62 rotating in a vertical plane orthogonal to the optical axis Ax is sent by the cooling fan 60 to a space 40*a* between the plurality of heat dissipation fins 40B from the rear side of the space 40*a*.

Next, specific structures of the projection lens 20 and the tubular holder 50 are explained.

Among the first and second lenses 22, 24 included in the projection lens 20, the first lens 22 located on the front side is a biconvex lens, and the second lens 24 located on the rear side is a concave meniscus lens projecting toward the rear side.

Both the first and second lenses 22, 24 are resin lens. Specifically, the first lens 22 is made of polymethyl methacrylate (PMMA) resin, and the second lens 24 is made of polycarbonate (PC) resin or polystyrene (PS) resin. Thus, chromatic aberration of the projection lens 20 is minimized.

An antireflection treatment is performed on an entire front surface 22*a* and an entire rear surface 22*b* of the first lens 22, and an entire front surface 24*a* and an entire rear surface 24*b* of the second lens 24. This antireflection treatment is performed by forming an antireflection film 26 on each of the surfaces of the first and second lenses 22, 24.

The tubular holder 50 includes a first holder 52 that supports the first lens 22, a second holder 54 that supports the second lens 24 behind the first holder 52, and a third holder 56 attached to the first holder 52 and the second holder 54.

The first holder 52 is in contact with an outer peripheral surface of the first lens 22 and an outer peripheral edge part of the rear surface 22*b* of the first lens 22, and is also in contact with an outer peripheral surface of the second lens 24 and an outer peripheral edge part of the front surface 24*a* of the second lens 24. The second holder 54 is in contact with an outer peripheral surface of the second lens 24 and an outer peripheral edge part of a rear surface 24*b* of the second lens 24. The third holder 56 is formed so as to cover the first holder 52, and a rear end part of the third holder 56 is fixed to the second holder 54 in a state where a front end part of the third holder 56 is in contact with the outer peripheral edge part of a front surface 22*a* of the first lens 22.

In a peripheral surface part of the tubular holder 50, an upper opening 50*a* and a lower opening 50*b* are formed in a portion between the first lens 22 and the second lens 24. The upper opening 50*a* extends through an upper end part of the peripheral surface part in the upper-lower direction, and the lower opening 50*b* extends through a lower end part of the peripheral surface part in the upper-lower direction. The upper opening 50*a* and the lower opening 50*b* are both formed by cutting out portions of the first and third holders 52, 56.

The vehicular lamp 10 according to the embodiment includes a wind guide path AP1 that guides wind generated by the cooling fan 60 to a position where the wind hits surfaces of the projection lens 20.

In order to form the wind guide path AP1, a duct 70 extending in the front-rear direction is disposed above the optical axis Ax so as to connect an upper end part of the heat sink 40 and an upper end part of the tubular holder 50.

The duct 70 has a vent hole 70*a* extending in the front-rear direction. A rear end part of the vent hole 70*a* is bent toward the lower side and is open downwardly, and thus communicates with the space 40*a* between the plurality of heat dissipation fins 40B. Also, a front end part of the vent hole 70*a* is open downwardly and communicates with the upper opening 50*a* of the tubular holder 50.

As described above, the wind guide path AP1 is formed by the space 40*a* between the plurality of heat dissipation fins 40B, the vent hole 70*a* of the duct 70, and the upper opening 50*a* of the tubular holder 50. After wind generated by the cooling fan 60 is guided by the wind guide path AP1 into a space 20*a* between the first lens 22 and the second lens 24, the wind is discharged from the space 20*a* to an external space through the lower opening 50*b* of the tubular holder 50.

Figure 3:
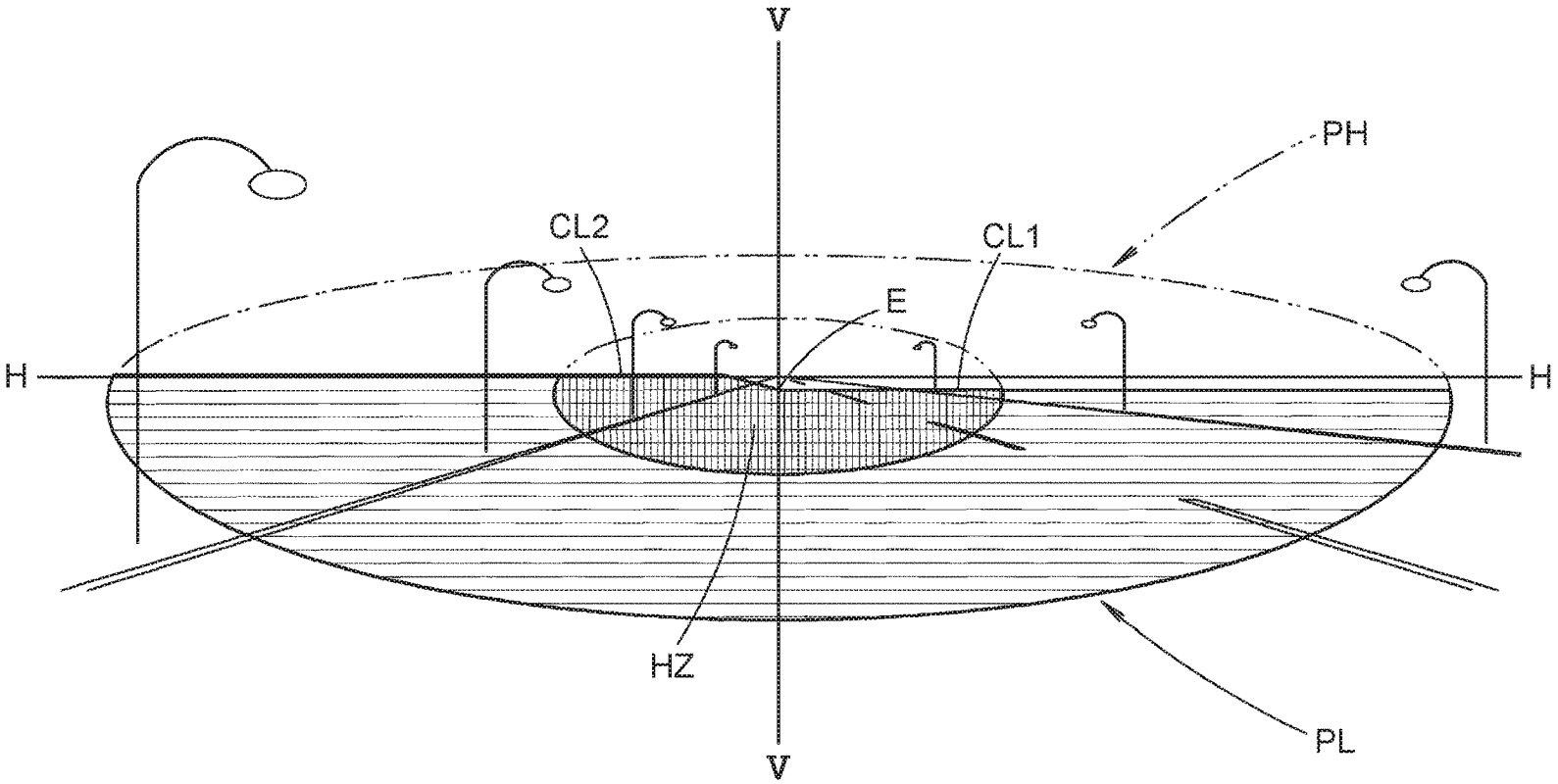
FIG. 3 is a view of a light distribution pattern formed by irradiation light from the vehicular lamp.

FIG. 3 is a view showing, in a perspective manner, a light distribution pattern formed by light emitted toward the front side from the vehicular lamp 10 onto a virtual vertical screen disposed at a position at a distance of 25 meters from the front of the vehicle.

The light distribution pattern shown by a solid line in the drawing is a low beam light distribution pattern PL.

The low beam light distribution pattern PL is a low beam light distribution pattern for the left light distribution, and its upper end edge has cutoff lines CL1, CL2 at different levels on the right and left sides. The cutoff lines CL1, CL2 extend in the horizontal direction at different levels on the right and left sides of the V-V line that vertically extends through H-V. H-V is a vanishing point in the lamp front direction. A part on the opposite lane side, which is the right side of the V-V line, is formed as the lower cutoff line CL1, and a part on the driving lane side, which is the left side of the V-V line, is formed as the upper cutoff line CL2 that extends to the upper level through an inclined part from the lower cutoff line CL1.

The low beam light distribution pattern PL is formed by lighting some of the plurality of light emitting diodes 32 arranged in the vertical and horizontal direction in the grid pattern, and projecting light emitting surfaces of the light emitting diodes 32 that are lit, onto the virtual vertical screen as an inverted projection image.

In the low beam light distribution pattern PL, an elbow point E, which is an intersection point between the lower cutoff line CL1 and the V-V line, is positioned slightly lower than the H-V, and a high intensity zone HZ is formed substantially around the elbow point E. The high intensity zone HZ is formed by increasing values of electric current supplied to some of the plurality of light emitting diodes 32 that are lit.

In this drawing, a light distribution pattern shown by an alternate long and two short dashes line is a high beam light distribution pattern PH.

The high beam light distribution pattern PH is formed by increasing the number of light emitting diodes 32 to be lit as compared to the case where the low beam light distribution pattern PL is formed.

Next, effects of the embodiment are explained.

The vehicular lamp 10 according to the embodiment is configured as a projector-type lamp unit including the projection lens 20 made of resin. Since the vehicular lamp 10 includes the cooling fan 60 as a wind generator configured to generate wind, and the wind guide path AP1 configured to guide wind generated by the cooling fan 60 to a position where the wind hits the surfaces of the projection lens 20, it is possible to cool the projection lens 20 efficiently.

With the above-described structure, it is possible to suppress an increase in the temperature of the projection lens 20. Therefore, large changes in the refractive index and the focal distance of the projection lens 20 are prevented in advance. Thus, it is possible to effectively suppress degradation of a light distribution pattern formed by light emitted by the vehicular lamp 10. In particular, in the low beam light distribution pattern PL, it is possible to effectively suppress degradation of visibility of the cutoff lines CL1, CL2.

Furthermore, it is possible to achieve the above-described effects with the less expensive structure as compared to a conventional case where a heat ray cutting filter is provided.

As described so far, according to the embodiment, in the projector-type vehicular lamp 10, it is possible to suppress degradation of a light distribution pattern, with an inexpensive structure even when the projection lens 20 made of resin is used.

Moreover, by employing the structure according to the embodiment, it is possible to suppress an increase in the temperature of the projection lens 20, and to suppress an increase in the temperature of members located around the wind guide path AP1 (for example, the tubular holder 50 and so on).

The projection lens 20 according to the embodiment has a structure in which the first lens 22 and the second lens 24 are disposed at a given interval in the front-rear direction, and the wind guide path AP1 is configured to guide wind to the space 20*a* between the first lens 22 and the second lens 24. Therefore, it is possible to cool the projection lens 20 extremely efficiently.

In this case, in the embodiment, the upper opening 50*a* that forms a part of the wind guide path AP1 is located at the upper end position in the peripheral surface part of the tubular holder 50, and the lower opening 50*b* is located at the lower end position in the peripheral surface part of the tubular holder 50. Therefore, air flows smoothly in the space 20*a* between the first lens 22 and the second lens 24.

Further, in the embodiment, the light source of the vehicular lamp 10 includes the light emitting diodes 32 supported by the heat sink 40, and the wind generator is the cooling fan 60 configured to dissipate heat of the heat sink 40. Therefore, it is not necessary to provide an additional wind generator in order to cool the projection lens 20. Thus, it is possible to suppress degradation of a light distribution pattern with an even more inexpensive structure.

In addition, in the embodiment, the light source of the vehicular lamp 10 includes the plurality of light emitting diodes 32 arranged in the grid pattern. Therefore, by selectively lighting some of the plurality of light emitting diodes 32, the low beam light distribution pattern PL and the high beam light distribution pattern PH (or other light distribution pattern) can be formed. In the case where the plurality of light emitting diodes 32 are provided as described above, the temperature of the projection lens 20 tends to increase. Therefore, use of the structure according to the embodiment is particularly effective.

In the embodiment, since the antireflection films 26 are formed on the front surface 22*a* and the rear surface 22*b* of the first lens 22 in the projection lens 20, and the front surface 24*a* and the rear surface 24*b* of the second lens 24 in the projection lens 20, it is possible to suppress degradation of the light distribution pattern, and to improve lamp efficiency.

In the above-described embodiment, the antireflection films 26 are formed on the surfaces of the first and second lenses 22, 24 that constitute the projection lens 20. However, the antireflection films 26 may be formed on portions of the surfaces. Also, instead of the antireflection films 26, the moth-eye structures or the like may be formed.

In the above-described embodiment, the wind guide path AP1 is disposed above the optical axis Ax. However, the wind guide path AP1 may be disposed at a different position.

In the above-described embodiment, the first lens 22 is made of PMMA resin and the second lens 24 is made of PC resin or PS resin. However, each of the first lens 22 and the second lens 24 may be made of resin other than the resin described above (for example, silicone resin).

In the above-described embodiment, the projection lens 20 includes the first and second lenses 22, 24. However, the projection lens 20 may be a single lens or may include three lenses or more. In the case where the projection lens 20 is a single lens, a diffraction structure may be provided in its front surface and/or rear surface.

In the above-described embodiment, the vehicular lamp 10 is a headlamp. However, the vehicular lamp 10 may be configured as another lamp (for example, a fog lamp).

Next, a modified example of the above-described embodiment is explained.

Figure 4:
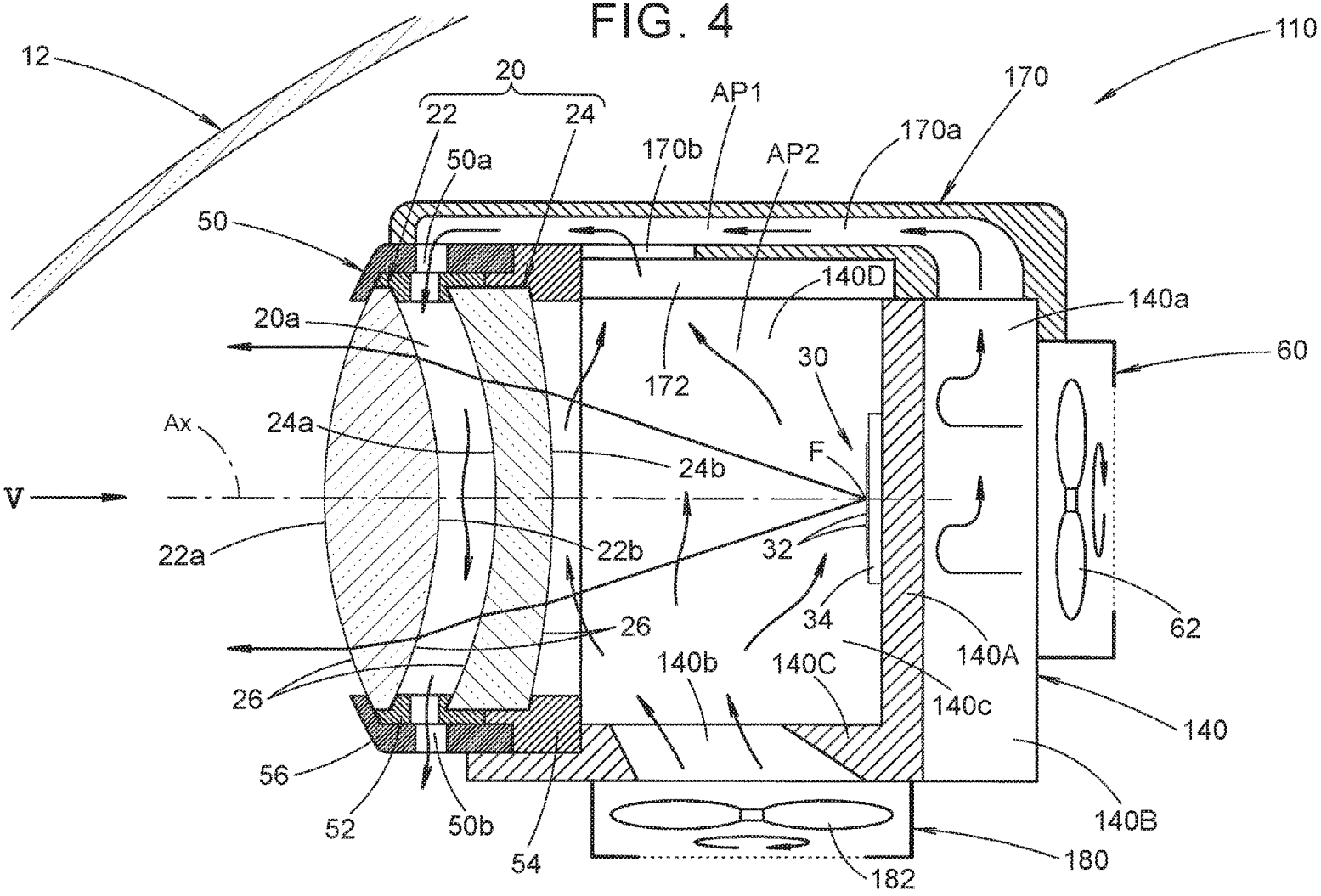
FIG. 4 is a view similar to FIG. 1, FIG. 4 showing a modified example of the above-described embodiment.
Figure 5:
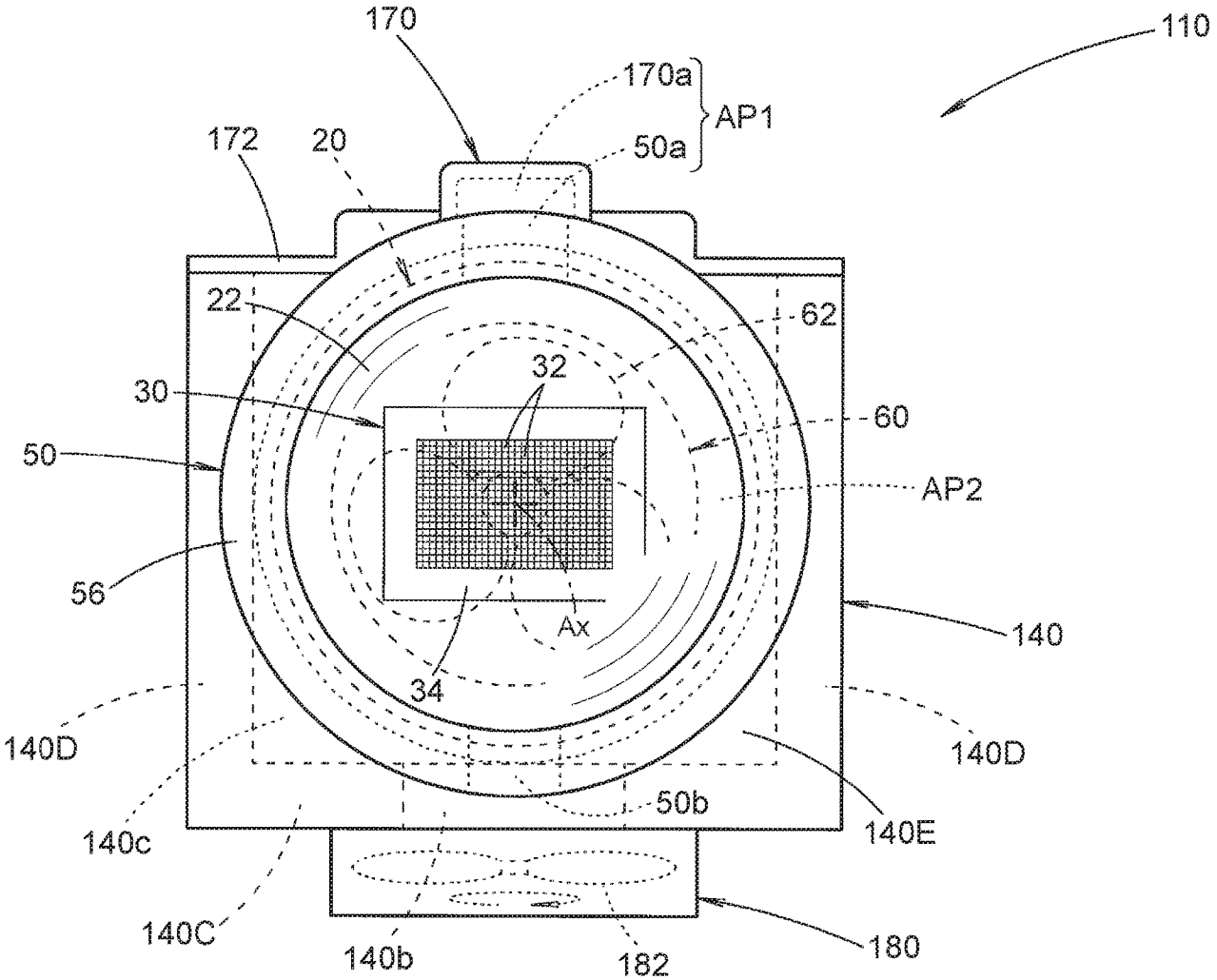
FIG. 5 is a view similar to FIG. 2, FIG. 5 showing the modified example.

FIG. 4 and FIG. 5 are views similar to FIG. 1 and FIG. 2, respectively, showing a vehicular lamp 110 according to the modified example.

As shown in the drawings, the basic structure of the vehicular lamp 110 is similar to the basic structure in the above-described embodiment. The vehicular lamp 110 is different from the vehicular lamp 10 in the above-described embodiment in that a motor fan 180 serving as a second wind generator, and a wind guide path AP2 serving as a second wind guide path are provided. Thus, structures of a heat sink 140 and a duct 170 are partially different from the heat sink 40 and the duct 70 in the above-described embodiment.

In other words, in the modified example, the motor fan 180 is attached to a lower surface of a bottom wall part 140C of the heat sink 140. Also, in the bottom wall part 140C of the heat sink 140, an opening 140*b* is formed to extend through the bottom wall part 140C in the upper-lower direction.

The motor fan 180 has a structure similar to that of the cooling fan 60. The motor fan 180 sends wind generated by a fan body 182 rotating in a horizontal plane to a space 140*c* from a lower side of the space 140*c*. The space 140*c* is surrounded by a body 140A, the bottom wall part 140C, and a pair of right and left side wall parts 140D, and a front wall part 140E of the heat sink 140.

The opening 140*b* formed in the bottom wall part 140C is formed such that the opening 140*b* extends upward and is inclined toward the front side in an upward direction, and a front-rear width of the opening 140*b* becomes narrower gradually in the upward direction. This allows wind from the motor fan 180 to be efficiently sent to a rear surface 24*b* of a second lens 24 inside the space 140*c*.

In this modified example as well, wind generated by the cooling fan 60 is guided from a space 140*a* between a plurality of heat dissipation fins 140B of the heat sink 140 toward a vent hole 170*a* of the duct 170.

The duct 170 in the modified example has substantially the same structure as that of the duct 70 of the above-described embodiment. However, the duct 170 in the modified example is different from the duct 70 in the above-described embodiment in that a lid member 172 is formed integrally with the duct 170. The lid member 172 extends to both the right and left sides from the duct 170 so as to cover upper end surfaces of the body 140A and the pair of side wall parts 140D of the heat sink 140. Since the duct 170 and the lid member 172 are attached to the upper end surface of the heat sink 140, the space 140*c* is separated from an external space, and thus, the light source unit 30 is protected from dust and so on.

In this duct 170, an opening 170*b* is formed in a part near the rear side of an upper end part of the tubular holder 50 in order to allow the space 140*c* to communicate with the vent hole 170*a*. Thus, wind sent into the space 140*c* from the motor fan 180 is sent into the vent hole 170*a* of the duct 170 through the opening 170*b*.

As described above, the second wind guide path AP2 is formed by the opening 140*b* formed in the bottom wall part 140C, the space 140*c*, the opening 170*b* of the duct 170, a front half of the vent hole 170*a* of the duct 170, and the upper opening 50*a* of the tubular holder 50, and the second wind guide path AP2 joins a wind guide path AP1 in the vent hole 170*a* of the duct 170.

In the wind guide path AP2, a large part of wind sent into the space 140*c* from the motor fan 180 through the opening 140*b* of the bottom wall part 140C moves upward along the rear surface 24*b* of the second lens 24, and then is sent into the vent hole 170*a* through the opening 170*b* of the duct 170. However, a part of the rest of the wind moves upward in the vicinity of the front side of the light source unit 30, and then is sent into the vent hole 170*a* through the opening 170*b* of the duct 170.

Next, effects of this modified example are explained.

In the vehicular lamp 110 according to this modified example as well, since wind generated by the cooling fan 60 (first wind generator) is guided by the wind guide path AP1 (first wind guide path) to a space 20*a* between a first lens 22 and the second lens 24 in a projection lens 20, it is possible to cool the projection lens 20 efficiently.

In addition, according to this modified example, since wind generated by the motor fan 180 (second wind generator) is guided by the wind guide path AP2 (second wind guide path) to the space 20*a* between the first lens 22 and the second lens 24 in the projection lens 20, it is possible to cool the projection lens 20 more efficiently.

Furthermore, in the wind guide path AP2, a large part of wind that is sent from the motor fan 180 to the space 140*c* through the opening 140*b* of the bottom wall part 140C moves upward along the rear surface 24*b* of the second lens 24. Therefore, it is possible to cool the projection lens 20 even more efficiently.

In the wind guide path AP2, a part of wind sent from the motor fan 180 to the space 140*c* through the opening 140*b* of the bottom wall part 140C moves upward in the vicinity of the front side of the light source unit 30. Therefore, it is possible to suppress an increase in the temperature of members around the wind guide path AP2 (for example, the light source unit 30 and so on).

In particular, in this modified example, in order to protect the light source unit 30 from dust and so on, the duct 170 and the lid member 172 are attached to the upper end surface of the heat sink 140. Because the space 140*c* inside the heat sink 140 is separated from an external space and the temperature tends to increase, the structure including the motor fan 180 and the wind guide path AP2 is extremely effective.

In the above-described modified example, light emitted from the plurality of light emitting diodes 32 that serve as the light source enters the projection lens 20 directly. However, a two-dimensional image forming device (for example, a light transmissive liquid crystal shutter) may be disposed between the light source and the projection lens 20, and light emitted from the light source may enter the projection lens 20 through the two-dimensional image forming device. When this structure is used, it is possible to cool the two-dimensional image forming device with the use of wind guided by the wind guide path AP2.

The numerical values described as specifications in the above-described embodiment and its modified example are only examples, and they may be set to different values as necessary.

Further, the disclosure is not limited to the structures described in the above-described embodiment and its modified example. It is possible to employ structures obtained by making various modifications to the structures described in the above-described embodiment and its modified example.

What is claimed is:

1. A vehicular lamp comprising:

a projection lens made of resin, wherein the projection lens includes a first lens and a second lens disposed at a given interval in a front-rear direction;

a light source that is disposed behind the projection lens, the vehicular lamp being configured such that light from the light source is emitted forward through the projection lens;

a translucent cover disposed in front of the projection lens;

a wind generator configured to generate wind;

a wind guide path configured to guide the wind generated by the wind generator to a position where the wind hits a surface of the projection lens; and a tubular holder that supports the first lens and the second lens, wherein the tubular holder includes a plurality of openings provided adjacent to the first lens and the second lens, wherein the wind guide path is configured to guide the wind generated by the wind generator into at least one of the plurality of openings.

2. The vehicular lamp according to claim 1, wherein:

the wind guide path is configured to guide the wind into a space between the first lens and the second lens.

3. The vehicular lamp according to claim 2, wherein the plurality of openings are provided between a location where the first lens is supported by the tubular holder and a location where the second lens is supported by the tubular holder.

4. The vehicular lamp according to claim 2, wherein:

the wind generator includes a first wind generator and a second wind generator, the wind guide path includes a first wind guide path and a second wind guide path, the first wind guide path is configured to guide wind generated by the first wind generator into the space between the first lens and the second lens, and the second wind guide path is configured to guide wind generated by the second wind generator into the space between the first lens and the second lens.

5. The vehicular lamp according to claim 1, wherein:

the light source includes a light emitting diode supported by a heat sink, and the wind generator is a cooling fan configured to dissipate heat from the heat sink.

6. The vehicular lamp according to claim 1, wherein the light source includes a plurality of light emitting diodes arranged in a grid pattern.

7. The vehicular lamp according to claim 1, wherein the surface of the projection lens is subjected to antireflection treatment.

8. A vehicular lamp comprising:

a projection lens made of resin;

a light source that is disposed behind the projection lens, the vehicular lamp being configured such that light from the light source is emitted forward through the projection lens;

a wind generator configured to generate wind; and a wind guide path configured to guide the wind generated by the wind generator to a position where the wind hits a surface of the projection lens, wherein:

the projection lens includes a first lens and a second lens disposed at a given interval in a front-rear direction, the wind guide path is configured to guide the wind into a space between the first lens and the second lens, the wind generator includes a first wind generator and a second wind generator, the wind guide path includes a first wind guide path and a second wind guide path, the first wind guide path is configured to guide wind generated by the first wind generator into the space between the first lens and the second lens, and the second wind guide path is configured to guide wind generated by the second wind generator into the space between the first lens and the second lens.

9. The vehicular lamp according to claim 8, wherein:

the light source includes a light emitting diode supported by a heat sink, and at least one of the first wind generator and the second wind generator is a cooling fan configured to dissipate heat from the heat sink.

10. The vehicular lamp according to claim 8, wherein the light source includes a plurality of light emitting diodes arranged in a grid pattern.

11. The vehicular lamp according to claim 8, wherein a surface of the projection lens is subjected to antireflection treatment.

12. The vehicular lamp according to claim 8, further comprising a translucent cover disposed in front of the projection lens.

* * * * *